US007950992B2

(12) United States Patent
Fairhurst

(10) Patent No.: US 7,950,992 B2
(45) Date of Patent: May 31, 2011

(54) BLACKJACK SIDE WAGER

(76) Inventor: Barry Fairhurst, Boca Raton, FL (US)

( * ) Notice: Subject to any disclaimer, the term of this patent is extended or adjusted under 35 U.S.C. 154(b) by 0 days.

(21) Appl. No.: 12/608,992

(22) Filed: Oct. 29, 2009

(65) Prior Publication Data

US 2010/0207327 A1 Aug. 19, 2010

Related U.S. Application Data

(60) Provisional application No. 61/153,040, filed on Feb. 17, 2009.

(51) Int. Cl.
*A63F 1/00* (2006.01)

(52) U.S. Cl. ..... 463/12; 273/292

(58) Field of Classification Search ..... 273/292, 273/274, 309; 463/12
See application file for complete search history.

(56) References Cited

U.S. PATENT DOCUMENTS

| | | | | |
|---|---|---|---|---|
| 5,454,570 | A | 10/1995 | Karal | |
| 5,743,532 | A | 4/1998 | Lafferty | |
| 6,896,266 | B1 * | 5/2005 | Terminel | 273/292 |
| 2005/0012273 | A1 | 1/2005 | Bruno | |
| 2007/0075497 | A1 | 4/2007 | Friedman | |
| 2007/0216098 | A1 | 9/2007 | Santiago | |

* cited by examiner

*Primary Examiner* — Benjamin H Layno
(74) *Attorney, Agent, or Firm* — Muskin & Cusick LLC

(57) ABSTRACT

A method to implement a variation of casino blackjack wherein if the dealer's up-card is a not an ace, then the player can place an optional side wager. If the player places the optional side wager, and the dealer's hole-card is either a 10-valued card or an ace, then the player wins a payout on the side wager otherwise the player loses the side wager.

6 Claims, 4 Drawing Sheets

BLACKJACK SIDE WAGER

CROSS REFERENCE TO RELATED APPLICATIONS

This application claims benefit to application Ser. No. 61/153,040, entitled, "Picture-in-the-Hole Blackjack," filed on Feb. 17, 2009, which is incorporated by reference herein in its entirety.

BACKGROUND OF THE INVENTION

1. Field of the Invention

The present general inventive concept is directed to a method, apparatus, and computer readable storage medium directed to a variation of the game of blackjack.

2. Description of the Related Art

Casino blackjack is well known in the art, for example see U.S. patent publication 2003/0155715, which is incorporated by reference herein in its entirety.

Casino blackjack is well known in the Art. FIG. 1 is a flowchart illustrating the game of blackjack. Points totals are computed by adding the standard rank value of each card, with face valued cards (tens, jacks, queens, kings) being given a value of 10, and aces being given a value of 1 or 11, whichever results in a better hand. A soft point total is where at least one ace is given the value of 11. A hard point total is a hand with all aces counting as 1.

In operation 100, the player makes a main wager by placing chips on a table. Then, in operation 102, the dealer deals two initial cards to each player (either face up or face down) and two initial cards to the dealer, typically one face down, and one face up (the "up-card"). Then the player can decide whether to hit, stand, double, or split. If the player decides to hit, then the method proceeds to operation 106, which deals an additional card to a player. If a determination 108 determines that the player has busted (the player's hard point total is over 21), then the player loses the game and thus loses the main wager in operation 110, which ends the game. If the determination 108 determines that the player has not busted, then the method returns to operation 104, where the player can make another decision whether to hit or stand. In operation 104, the player can also double by place an additional wager of up to the main wager, but the player is limited to drawing only one additional card before the player must stand.

If the player has not busted out (either stands on his or her initial two cards or draws cards but has a point total under 22), then the method proceeds to operation 114, which plays out the dealer's hand according to predetermined rules. If the dealer's total is greater than a predetermined amount (typically 17), then the dealer stands (proceeds to operation 122). If the dealer's total is not greater than the predetermined amount, the method proceeds to operation 116 which deals an additional card to the dealer. If it is then determined 118 that the dealer has not busted, the method returns to operation 114. If the dealer has busted, then the player wins the game and the main wager in operation 120.

In operation 122, both the player and the dealer have played out their hand and neither have busted. Thus, their point totals are compared. If the dealer's point total is determined in operation 124 to be lower than the player's point total, then the player wins the game and the main wager in operation 120. Otherwise, if the dealer's point total is determined 128 to be greater than the player's point total, then the player loses the game and the main wager in operation 130. If the player's point total ties the dealer's point total, then that results in a "push" in operation 126 in which the player doesn't win or lose the main wager (the main wager bet is a wash).

If a player is initially dealt two identically ranked cards in operation 102, players can also split in operation 104 by placing an additional split wager equal in value to the main wager, and the player's two initial cards are separated and the dealer deals an additional card on each. The player then plays out each of the two separate hands, each from operation 104. Depending on house rules, players may or may not be allowed to resplit cards.

Players of the standard blackjack game have the option of making an "insurance" wager when the dealer's up-card is an ace. If the player makes the insurance wager, the player is betting that the dealer has blackjack (i.e., the dealer's hole card is a ten valued card), and if it turns out to be a ten valued card the player wins 3:2 on the insurance wager otherwise the player loses.

Some players like the ability to "hedge" their bet, for example, if they are dealt a good hand (e.g., 20 or blackjack), and the dealer has an ace as the up-card, some players feel that taking insurance is a smart bet since it serves as a hedge in case they lose their main bet.

However, the insurance bet is only available when the dealer has an ace showing as the dealer's up-card. What is needed is other types of bets that players can make in other situations. What is also needed is a bet that allows a player to create winning situations that previously did not exist.

SUMMARY OF THE INVENTION

It is an aspect of the present invention to provide flexibility and innovations in casino game play.

The above aspects can be obtained by method that includes (a) receiving a main wager from a player; (b) providing a physical deck(s) of cards; (c) dealing a player's hand and a dealer's hand, the dealer's hand comprising a dealer's up-card and a dealer's hole-card; (d) determining if the dealer's up-card is a not an ace, and if the dealer's up-card is not an ace, then offering the player an option to place a side wager; (e) playing out the player's hand and revealing the dealer's hole-card; and (f) determining if the dealer's hole-card is either a 10-valued card or an ace, and if so, then if the player placed the side wager then paying the side wager a payout otherwise taking the side wager.

These together with other aspects and advantages which will be subsequently apparent, reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

Further features and advantages of the present invention, as well as the structure and operation of various embodiments of the present invention, will become apparent and more readily appreciated from the following description of the preferred embodiments, taken in conjunction with the accompanying drawings of which.

DESCRIPTION OF THE PREFERRED EMBODIMENTS

Figure 1:
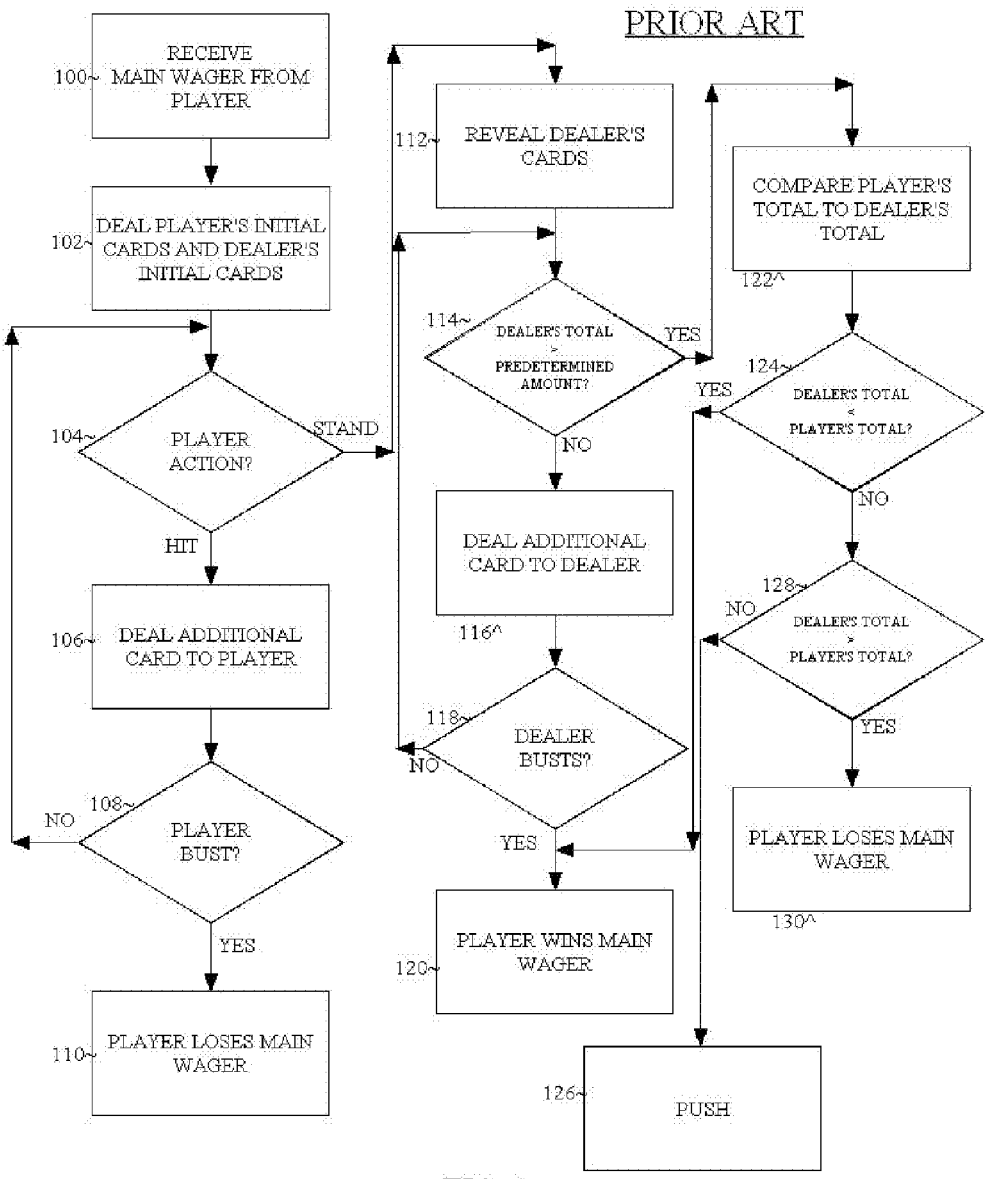
FIG. 1 is a flowchart of a method of wagering on a standard prior art blackjack game.

Reference will now be made in detail to the presently preferred embodiments of the invention, examples of which are illustrated in the accompanying drawings, wherein like reference numerals refer to like elements throughout.

The present inventive concept relates to a method, apparatus, and computer readable storage medium to implement a modified blackjack game. The modified blackjack game (which can be called "Picture in the Hole") includes a side wager that players can place on the value of the dealer's hole-card. The side wager can only be placed when the dealer's up-card is in a set of predefined values (in one embodiment, any card but an ace). If the side wager is placed, and the dealer's hole-card is in a set of predefined values (e.g., 10s, jacks, queens, kings, aces), then the side wager wins and is paid a payout. The wager can be made at any time during the player's hand, but may not be made after the action has moved on to another player or to the dealer. It is noted that the side wager is an alternative to insurance, in that the side wager and insurance cannot be made at the same time. If the dealer has an ace showing, the player can take insurance but not the side wager described herein. If the dealer does not have an ace showing, then the player can take the side wager described herein but not insurance. A different variety of standard blackjack rules can be used with the game, one such set of rules is: double on any two cards; double after split; dealer hits soft 17; resplit any pair, including aces; no surrender; 6 or 8 decks, shuffled after every round via a continuous shuffling machine (CSM). Of course many other variations of rules can be used as well. A CSM may be preferred in order to reduce the effectiveness or card counters.

Figure 2:
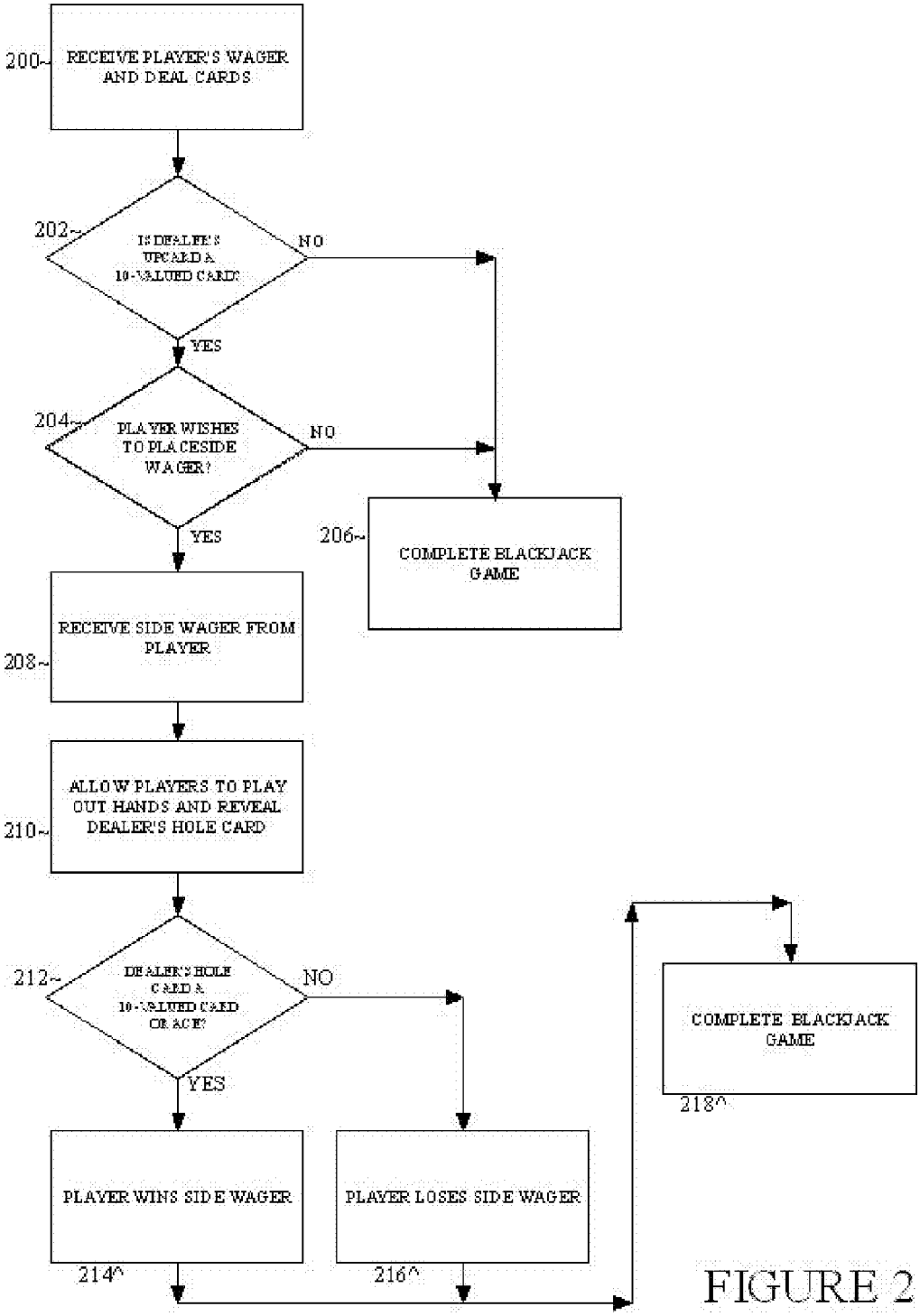
FIG. 2 is a flowchart of a method of wagering on a blackjack variation, according to an embodiment.

FIG. 2 is a flowchart of a method of wagering on blackjack, according to an embodiment.

The method can begin with operation 200, wherein the house (casino) receives the player's main wager (on whether the player wins or loses his or her blackjack game) and deals cards. The cards dealt typically comprise the player's initial hand and the dealer's initial hand. The player's initial hand is formed of two cards, dealt either face up or face down depending on the house (or table) rules. The dealer's initial hand is formed of two cards, one face up (the up-card) and one face down (the hole-card).

From operation 200, the method proceeds to operation 202, which determines whether the dealer's up-card is not an ace. If the dealer's up-card is an ace, then the method proceeds to operation 206, which completes the blackjack game as known in the art. The blackjack game in operation 206 can also offer the player the option to take the standard insurance wager if the dealer's up-card is an ace. However, the current method does not allow the player to place the side wager described herein when the dealer's up-card is an ace in order to avoid confusion with the standard insurance bet.

If operation 202 determines that the dealer's up-card is not an ace, then the player has the option to place the side wager. The method proceeds to operation 204 which determines whether the player wishes to place the side wager. If the player does not want to place the side wager, then the method proceeds to operation 106, which completes the blackjack game as known in the art.

If in operation 204, the player wants to place the side wager, then the method proceeds to operation 208, which receives the side wager from the player. The player can place the side wager by placing chips in a designated betting area for the side wager. In one embodiment, the side wager can be equal to up to half of the main wager (placed in operation 200) plus all double down and split bets. Alternatively, the side wager can be equal to the main wager placed in operation 200. In another embodiment, the side wager can be equal to the main wager or less than the main wager, at the player's option. In yet another embodiment, the side wager can be any amount, even in excess of the main wager, as long as it does not exceed a house wager limit.

From operation 208, the method proceeds to operation 210, which allows the player (and any other players at the table) to play out their hands. This is done as known in the art by allowing the players to hit or stand on their hands. When all of the players have played out their hands, the dealer's hold card is then revealed.

From operation 210, the method proceeds to operation 212, which determines if the dealer's hole card is either 10-valued card (e.g., ten, jack, queen, king) or an ace. The suits do not matter. If the dealer's hole card is neither a 10-valued card nor an ace, then the method proceeds to operation 216, wherein the player loses the side wager which is taken by the dealer.

If in operation 212, it is determined that that the dealer's hole card is a 10-valued card or an ace, then the method proceeds to operation 214, wherein the player wins the side wager and is paid a payout based on the side wager. One payout that can be used for a winning side wager is 3:2 of the side wager, e.g., if the player placed a $1 side wager, the player would an additional $1.50 (in addition to the original $1 wager). Other payouts can be used as well.

It is noted that the order of operations can be varied to any sensible order and the method may not be required to be performed in the actual order illustrated in FIG. 1. For example, a dealer may check their hole card for blackjack before allowing the player's to play out their hands. If this is the case (and the dealer's up-card is not an ace), then the side wager (if placed) is resolved instantly without the player's having to play out their hands (since the dealer has blackjack there is no need to resolve player hands). It is also noted that in another embodiment of the invention, the player may be allowed to place the side wager at any point in the game, even after the player as played out his or her hand. For example, if the player has busted (exceeded 21), the player may still be allowed to place the side wager, of course as long as the conditions in operation 202 are met (the dealer's up-card is a 10-valued card).

In yet an alternate embodiment, the player wins the side wager when the dealer's hole card is only a 10-valued card but loses on all other card values (including ace). In this embodiment, the payout could be 2:1, although other payouts could be used as well. Thus, in this embodiment, in operation 212, it is determined whether the dealer's hole card is only a 10-valued card (10, jack, queen, king).

Figure 3:
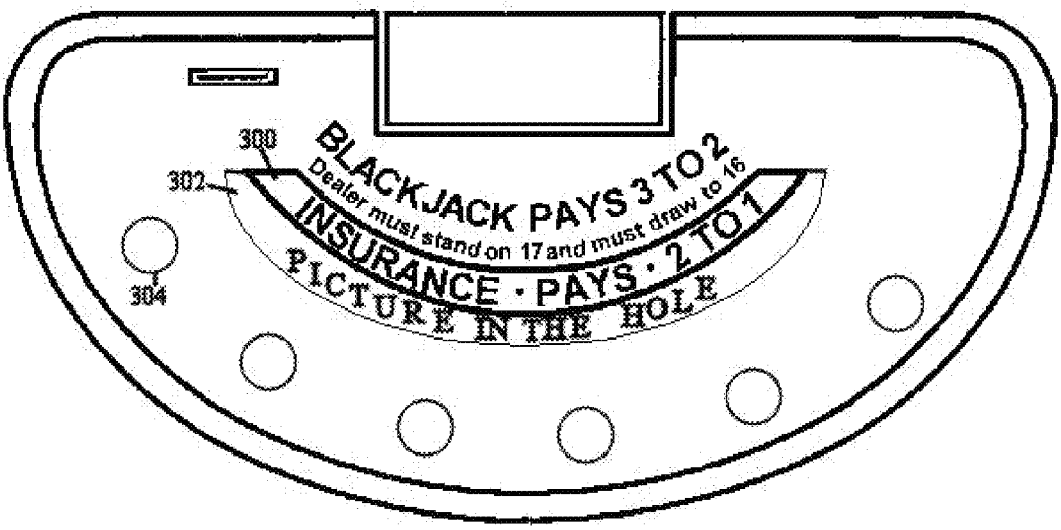
FIG. 3 is a drawing of a sample layout that can be used to implement the method of FIG. 2, according to an embodiment.

FIG. 3 is a drawing of a sample layout that can be used to implement the method of FIG. 1, according to an embodiment.

A main betting circle 304 is used for the player to place his or her main wager. This table layout has six betting circles so that six players can play simultaneously. An insurance bar 300 is used for players to place their insurance wagers. A "picture in the hole" bar 302 is used for players to place their side wagers.

A few examples of the game will now be presented. Ron bets $1 on the main wager, and is dealt a seven and an eight (for a total of 15). The dealer's up-card is a king. Since the dealer's up-card is a not an ace, the players are given the option to make the side wager. Ron decides to make the side wager and bets $1 on the side wager. Ron takes a hit and receives a 10, thereby busting and loses his main wager. The dealer reveals the dealer's hole card which turns out to be an ace. Since the dealer's hole card was from the set of (ace, 10, jack, queen, king) and Joe placed the side wager, then Ron wins a payout on the side wager. If the dealer's hole-card was not of this set (e.g., 2-9), Ron would have lost the side wager.

In another example, Doreen places a $2 main bet. Doreen is dealt two cards. The dealer's up-card is an ace. Doreen can make the standard insurance bet, but cannot make the side wager described herein because the dealer's up-card is an ace. If the dealer's up-card was anything but an ace (the suit does not matter), then Doreen would have the option to make the side wager.

In a further example, Steve places a $1 main bet. Steve is dealt a 10 and a 6. The dealer's up-card is a 10. Steve hits, receives a 9, and busts. Even though Steve has busted, Steve decides to make the side wager and places a $0.50 side wager. After all the players have resolved their hands, the dealer reveals the dealer's hole card to be a 3. Thus, Steve loses the side wager. It is noted that in this example, Steve placed the side wager even after Steve had resolved his hand. In an embodiment, the player can place the side wager at any point before the dealer's hole-card is revealed, even if the player has blackjack. In another embodiment, the player can only place the side wager before the player starts resolving his own hand. In a further embodiment, the player can only place the side wager before any player starts resolving his or her hand (which is how the prior art insurance bet typically operates).

In yet another example, Roxy wagers $2 on the main wager is dealt a 10 and a queen (for a total of 20). The dealer's up-card is a 5. Roxy makes the side wager of $1. Roxy stands and the dealer reveals the dealer's hole-card to be a 7. The dealer then draws a 10 and the dealer busts. Roxy wins the $2 main wager (since she had a 20 vs. the dealer bust) but loses the side wager (since the hole-card was not a 10 or an ace). If the dealer's hole-card was, for example, a 10, then Roxy would have won the side wager and won an additional $1.50.

As yet a further example, Barry makes a $2 main wager and is dealt a blackjack and the dealer's up-card is a 10. Barry makes a $1 side wager. The dealer reveals the dealer's hole-card to be an Ace. Barry pushes on the main wager (since both Barry and the dealer have blackjack), but Barry wins $1.50 on the side wager (since the dealer has an ace as the hole-card).

As a last example, Jeff makes a $5 main wager and is dealt a pair of 8s, while the dealer's up-card is a 5. Jeff decides to split the 8s and makes another $5 main wager. Jeff draws a 10 on one of the 8s, and stands, and draws a 3 on the other one of the 8s. Jeff doubles on the latter hand (8 plus 3 equals 11) and makes another $5 double wager, and receives a 7. Jeff also makes a side wager of $7.50. In this example, the house rule allows the player to make the side wager bet up to one half of the total amount bet by the player on the main wager and all doubles and splits (which in this example come to $15). The dealer reveals the dealer's hole-card to be a 7, and the dealer draws a 10 to bust. Jeff loses the side wager but wins the main wager, split wager, and double wager (a total of $15). Of course, in other embodiments, the amount of the player's side wager may be limited in other manners (as discussed in operation 208).

Figure 4:
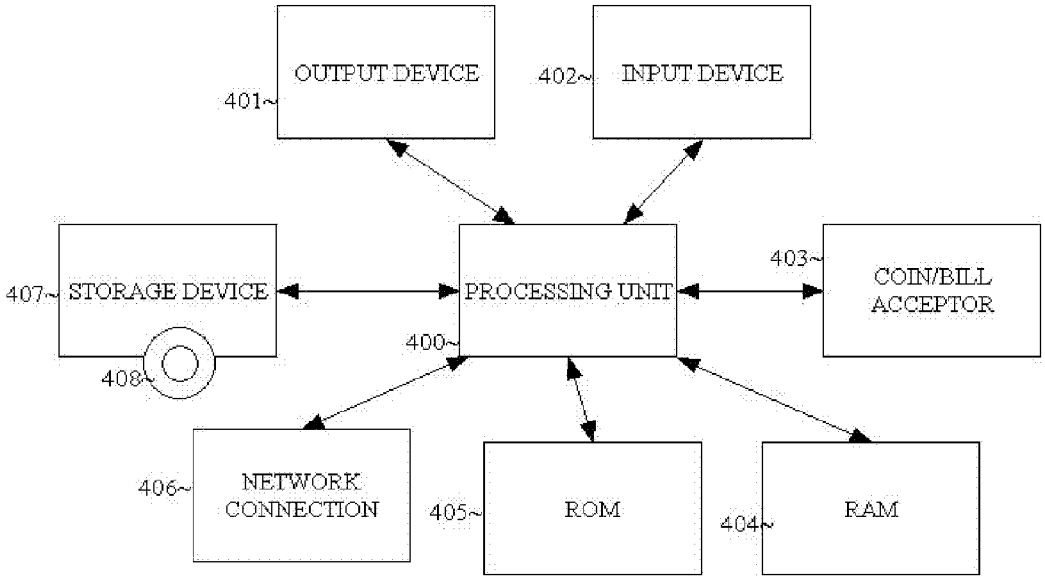
FIG. 4 is a block diagram illustrating exemplary hardware that can be used to implement an electronic version of methods described herein, according to an embodiment.

FIG. 4 is a block diagram illustrating exemplary hardware that can be used to implement an electronic version of methods described herein, according to an embodiment.

A processing unit 400 can be a microprocessor and any type of associated components (e.g., cache, bus, etc.) The microprocessor is connected (directly or indirectly) to an output device (e.g., touch-screen, speakers, reels, CRT, etc.) an input device (e.g., touch-screen, keyboard, mouse, etc.), a coin/bill acceptor 403 (which can also accept cashless tickets or electronically encoded payments cards), a RAM 404, a ROM 405, a network connection 406 (connecting the slot machine to any type of network such as a LAN, WAN, wifi, etc.), and a storage device 407 which can store programs and/or data to implement any of the methods described herein on a storage device 408.

The game can also be played over the Internet at an online casino (for fun or real money where legal), which serves the game to a remote player using a web browser or client which executes a program to implement the game.

The side wager ("the game") can be played with a standard physical deck of 52 cards or a shoe of any number of such decks. Non-standard deck(s) of cards can be used as well (e.g., wild cards, Spanish decks, etc.) The game can also be offered with any other variant of blackjack (e.g., "Spanish 21", etc.)

The physical (felt version) that is played in a physical casino uses real physical cards dealt on a gaming table, which typically has a felt layer on top to illustrate the layout (see FIG. 3). Physical chips are typically used in order to make wagers which are redeemable for cash at a cashier in the casino. When the player loses a wager, the dealer takes the player's wager (in the form of chips) and typically places it in the dealer's chip rack (which belongs to the house), while if the player wins a wager, the dealer typically pays out the players wager in chips according to the appropriate payout upon which the player keeps the chips.

It is also noted that any and/or all of the above embodiments, configurations, variations of the present invention described above can mixed and matched and used in any combination with one another. This also includes any prior document incorporated by reference, and any feature described herein can also be applied to any such documents. Any claim herein can be combined with any others (unless the results are nonsensical).

Moreover, any description of a component or embodiment herein also includes hardware, software, and configurations which already exist in the prior art and may be necessary to the operation of such component(s) or embodiment(s).

Further, the operations described herein can be performed in any sensible order. Any operations not required for proper operation can be optional. Further, all methods described herein can also be stored on a computer readable storage to control a computer.

The many features and advantages of the invention are apparent from the detailed specification and, thus, it is intended by the appended claims to cover all such features and advantages of the invention that fall within the true spirit and scope of the invention. Further, since numerous modifications and changes will readily occur to those skilled in the art, it is not desired to limit the invention to the exact construction and operation illustrated and described, and accordingly all suitable modifications and equivalents may be resorted to, falling within the scope of the invention.

What is claimed is:

1. An electronic gaming machine for playing a blackjack game, the machine comprising:

a processor, executing instructions to perform the following operations:

receiving a main wager from a player;

dealing a player's hand and a dealer's hand, the dealer's hand comprising a dealer's up-card and a dealer's hole-card;

determining if the dealer's up-card is anything but an ace, and if the dealer's up-card is anything but an ace, then offering the player an option to place a side wager;

playing out the player's hand and revealing the dealer's hole-card;

determining if the dealer's hole-card is in a set consisting of (10-valued card and ace), and if so, then if the player placed the side wager then paying the side wager a payout otherwise taking the side wager; and an output device to output results of the processor.

2. The machine as recited in claim 1, wherein the payout is 3:2 of the side wager.

3. The machine as recited in claim 1, wherein the offering the player an option is conducted before the playing out the player's hand.

4. The machine as recited in claim 1, wherein the offering the player an option is conducted after the player plays out the player's hand.

5. The machine as recited in claim 1, wherein an amount of the side wager must be equal to or less than one half of the main wager.

6. The machine as recited in claim 1, wherein an amount of the side wager must be equal to or less than one half of the main wager and any split or double wagers placed by the player.

* * * * *